US010008778B2

(12) United States Patent
Jones, III

(10) Patent No.: US 10,008,778 B2
(45) Date of Patent: Jun. 26, 2018

(54) DIRECTIONAL ARRAY FOR NEAR VERTICAL INCIDENCE SKYWAVE ANTENNA

(71) Applicant: Thomas O. Jones, III, San Diego, CA (US)

(72) Inventor: Thomas O. Jones, III, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 554 days.

(21) Appl. No.: 14/472,941

(22) Filed: Aug. 29, 2014

(65) Prior Publication Data

US 2016/0064831 A1 Mar. 3, 2016

(51) Int. Cl.

| | |
|---|---|
| ***H01Q 9/16*** | (2006.01) |
| ***H01Q 21/26*** | (2006.01) |
| ***H01Q 21/06*** | (2006.01) |

(52) U.S. Cl.

CPC ..... *H01Q 9/16* (2013.01); *H01Q 21/062* (2013.01); *H01Q 21/26* (2013.01)

(58) Field of Classification Search

CPC ..... H01Q 21/29
USPC ..... 343/812
See application file for complete search history.

(56) References Cited

U.S. PATENT DOCUMENTS 3,789,416 A * 1/1974 Kuecken ..... H01Q 21/26 343/792

3,995,276 A * 11/1976 Wolf ..... H01Q 1/1207 343/815

OTHER PUBLICATIONS

"Arrays: Linear Planar and Circular," Antenna Theory Analysis and Design, 3rd Edition, Constantine Balanis, 2005, pp. 283 to 371.*

Attieh Shahvarpour, Alejandro Alvarez Melcon, Christophe Caloz; Analysis of the Radiation Efficiency of a Horizontal Electric Dipole on a Grounded Dielectric Slab; Antennas and Propagation (APSURSI), 2011 IEEE International Symposium on; Jul. 3, 2011.

Tokarsky P. L. and Panchenko Yu. A.; Modeling Dipole Antenna Arrays Placed, Near to Interface Between Two Media; International Conference on Antenna Theory and Techniques, Sevastopol, Ukraine pp. 452-454, Sep. 17-21, 2007.

* cited by examiner

*Primary Examiner* — Graham Smith
(74) *Attorney, Agent, or Firm* — SPAWAR Systems Center Pacific; Kyle Eppele; J. Eric Anderson

(57) ABSTRACT

An antenna array comprising: four dipole antennas configured to function together as a directional, near vertical incidence skywave (NVIS) antenna with reduced side lobes, wherein each dipole antenna comprises two conductive elements and a feed point disposed between the two conductive elements, wherein the conductive elements of each of the four dipole antennas are disposed in an x-y plane of an x-y-z mutually orthogonal axes coordinate system, and wherein the conductive elements are substantially parallel with the x-axis and the x-y plane is substantially parallel with a ground plane; and wherein the feed points of the four dipole antennas are positioned on the x-y plane at approximately (x, 0), (−x, 0), (0, y), and (0, −y), and wherein the x-y plane is separated from the ground plane by a distance h that is less than or equal to 1/10 the wavelength (λ) of an operating frequency.

20 Claims, 18 Drawing Sheets

DIRECTIONAL ARRAY FOR NEAR VERTICAL INCIDENCE SKYWAVE ANTENNA

FEDERALLY-SPONSORED RESEARCH AND DEVELOPMENT

The United States Government has ownership rights in this invention. Licensing and technical inquiries may be directed to the Office of Research and Technical Applications, Space and Naval Warfare Systems Center, Pacific, Code 72120, San Diego, Calif., 92152; voice (619) 553-5118; ssc_pac_t2@navy.mil. Reference Navy Case Number 102320.

BACKGROUND OF THE INVENTION

The typical high-frequency (HF) communication monopole has a dipole pattern. The vertical null in the antenna pattern precludes significant HF reflections from the ionosphere to the region close to the antenna. A horizontal dipole at ¼ wavelength above ground could be used. However, the height of the dipole over ground is impractical at most HF frequencies. Placing the horizontal dipole closer to ground increases ground loss; part of this loss is the ground wave. A need exists for an improved near vertical incidence skywave antenna.

SUMMARY

Disclosed herein is an antenna array comprising four dipole antennas configured to function together as a directional, near vertical incidence skywave (NVIS) antenna with reduced side lobes. Each dipole antenna comprises two conductive elements and a feed point disposed between the two conductive elements. The conductive elements of each of the four dipole antennas are disposed in an x-y plane of an x-y-z mutually orthogonal axes coordinate system. The conductive elements are substantially parallel with the x-axis and the x-y plane is approximately parallel with a ground plane. The feed points of the four dipole antennas are positioned on the x-y plane at approximately (x, 0), (−x, 0), (0, y), and (0, −y). The x-y plane is separated from the ground plane by a distance h that is less than or equal to 1/10 the wavelength (λ) of an operating frequency.

Also disclosed herein is a method for providing a directional NVIS antenna with reduced side lobes that comprises the following steps. The first step provides four dipole antennas. Each dipole antenna comprises two conductive elements and a feed point disposed between the two conductive elements. The next step provides for positioning the four dipole antennas such that the conductive elements of each of the four dipole antennas are substantially parallel with an x-axis and are disposed in an x-y plane of an x-y-z mutually orthogonal axes coordinate system. The x-y plane is approximately parallel with a ground plane that is separated from the x-y plane by a distance h that is less than or equal to 1/10 the wavelength (λ) of an operating frequency. The next step provides for positioning the feed points of the four dipole antennas on the x-y plane at approximately (x, 0), (−x, 0), (0, y), and (0, −y).

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
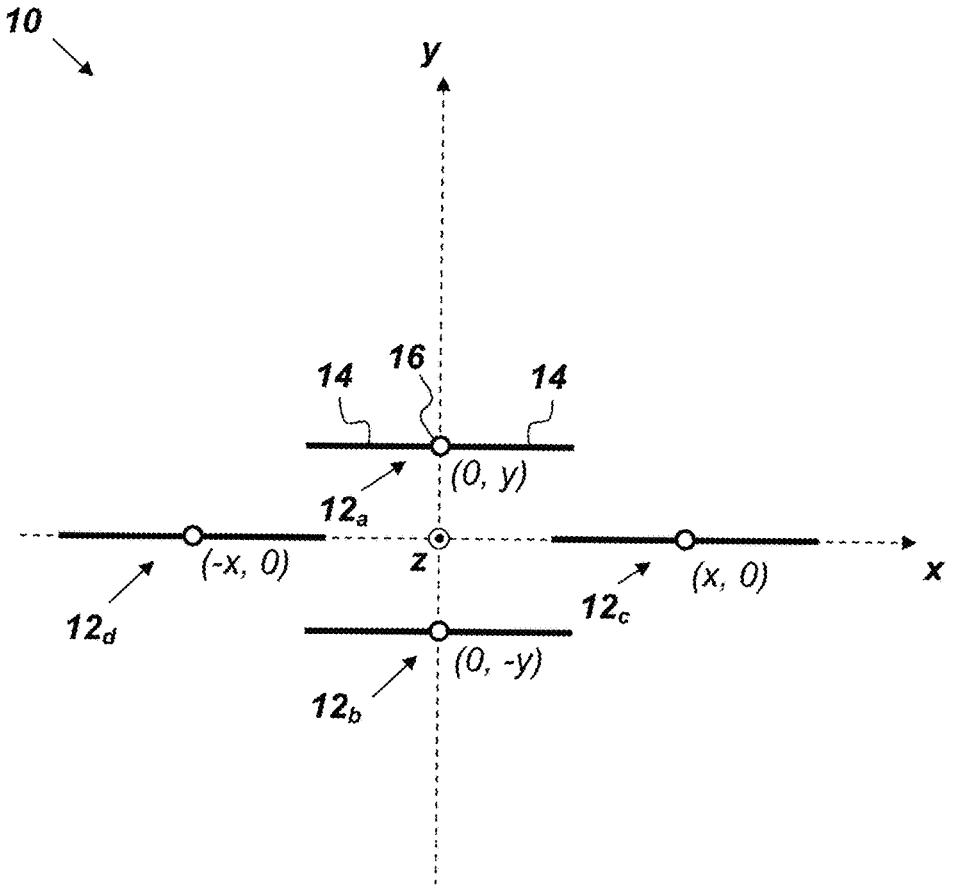
FIG. 1 is a top-view illustration of an embodiment of an NVIS antenna.

FIG. 1 is a top view of an illustration of a directional, near vertical incidence skywave (NVIS) antenna 10 that has an antenna pattern with high vertical gain and reduced side lobes. The NVIS antenna 10 comprises, consists of, or consists essentially of an array of four dipole antennas $\mathbf{12}_a$-$\mathbf{12}_d$. Each dipole antenna 12 comprises two conductive elements 14 and a feed point 16 disposed between the two conductive elements 14. In FIG. 1, only the feed point 16 and the conductive elements 14 corresponding to dipole antenna $\mathbf{12}_a$ are identified, but it is to be understood that each dipole antenna 12 has its own conductive elements 14 and its own feed point 16. The conductive elements 14 of each of the four dipole antennas $\mathbf{12}_a$-$\mathbf{12}_d$ are disposed in an x-y plane of an x-y-z mutually orthogonal axes coordinate system and are substantially parallel to the x-axis. As used herein, the term substantially parallel is intended to include parallela-lignments as well as alignments that diverge from parallel by up to 20 degrees. The feed points 16 of the four dipole antennas $\mathbf{12}_a$-$\mathbf{12}_d$ are positioned on the x-y plane at approximately (0, y), (0,−y), (x, 0), and (−x, 0), respectively. The size, shape, and material of the conductive elements 14 may be any desired size, shape, and material that result in an antenna that has a dipole pattern in free space. An antenna arm 3λ/8 has a narrow pattern; that is most likely too narrow for this design. An antenna arm smaller than λ/4 has a dipole pattern; very short dipole arms will have a much lower antenna radiation impedance.

Figure 2:
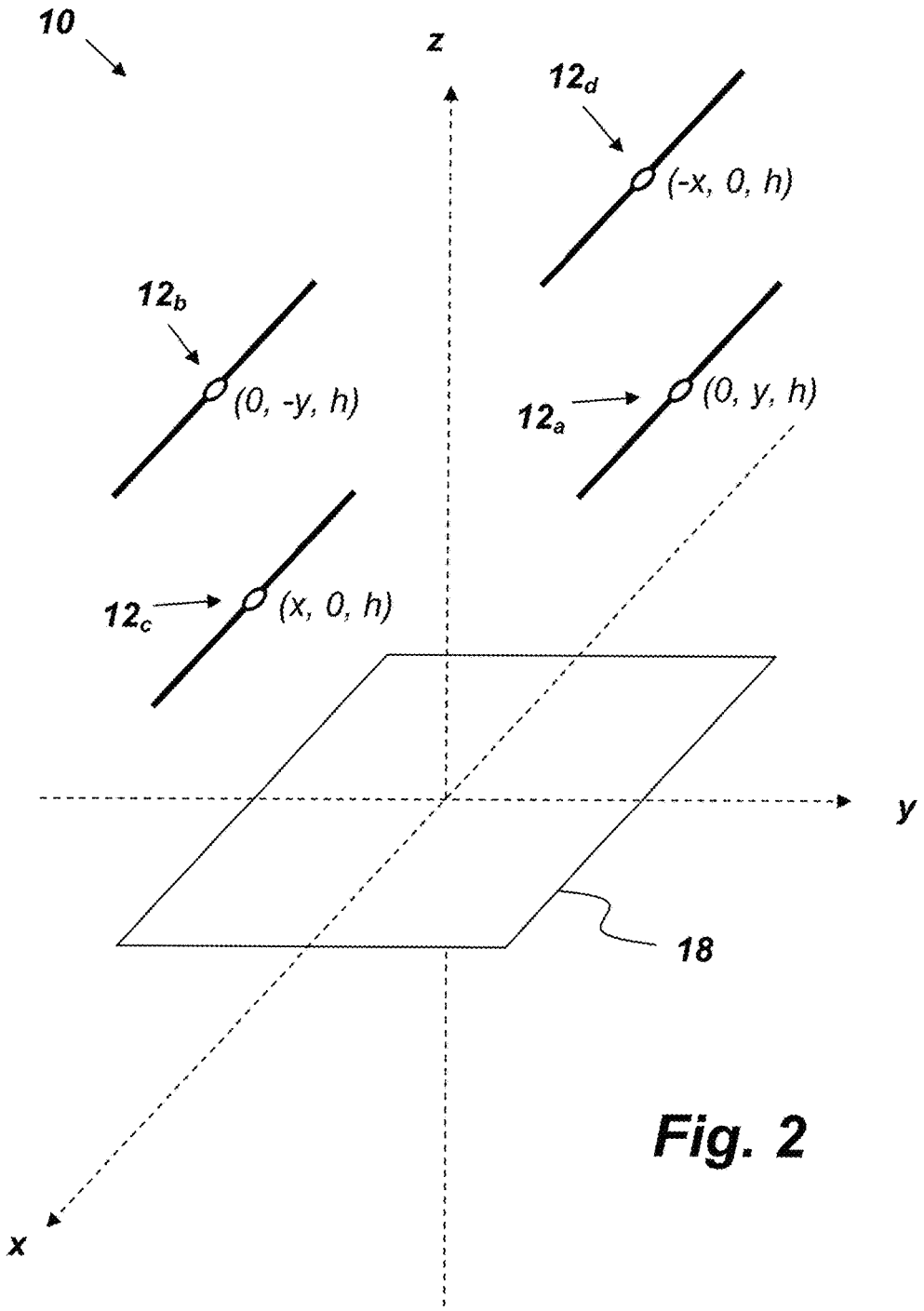
FIG. 2 is a perspective-view illustration of an embodiment of an NVIS antenna.

FIG. 2 is a perspective view of the NVIS antenna 10 showing how the x-y plane is substantially parallel with a ground plane 18. The ground plane 18 is depicted as having a square shape in FIG. 2. However, it is to be understood that the ground plane 18 may have any shape or size. The ground plane 18 is typically a conductive surface, but the ground plane 18 is not limited to conductive surfaces. The x-y plane, in which the dipole antennas 12 are situated, is separated from the ground plane 18 by a distance h that is less than or equal to 1/10 the wavelength (λ) of an operating frequency of the NVIS antenna 10. The NVIS antenna 10 may be scaled to operate in a variety of different frequencies from the very low frequency (VLF) realm through the high frequency (HF) realm to very high frequencies. This antenna design could be used on an integrated circuit. For example, the 1-meter height at 2 MHz scales to 2 mm height at 1 GHz. This concept could be applied to any frequency range for the NVIS antenna 10.

In the embodiment of the NVIS antenna 10 depicted in FIG. 1, the spacing between the feed points 16 of dipoles $\mathbf{12}_c$ and $\mathbf{12}_d$ can adjusted from λ/2 to λ. The spacing between the feed points 16 of dipoles $\mathbf{12}_a$ and $\mathbf{12}_b$ can adjusted from λ/1000 to λ. In other words, the value x, as shown in FIGS. 1 and 2, may be within the range of λ/4 to λ/2, and the value y may be within the range of λ/2000 to λ/2. When the spacing is λ between the dipoles 12, the interference is along the x- and y-axis directions. If the spacing between the dipoles is reduced to $\lambda/\sqrt{2}$; the distance between adjacent dipoles 12 is λ/2. The interference is along the diagonal. The spacing between dipoles $\mathbf{12}_a$-$\mathbf{12}_d$ may be reduced to improve the directivity pattern as described below. The spacing between $\mathbf{12}_c$-$\mathbf{12}_d$ controls the back lobe pointing behind the main lobe. The spacing between $\mathbf{12}_a$-$\mathbf{12}_b$ controls the two side lobes.

The NVIS antenna 10 is compared herein to models of a single horizontal dipole and of an array of two horizontal dipoles—all of which were modeled by antenna modeling software (EZNEC-Pro4®). The antenna patterns were modeled with a general purpose, three-dimensional (3-D) electromagnetic simulator, Computer Simulation Technology's (CST's) Microwave Studio® T-solver (time domain). A single 2-MHz horizontal dipole 1 meter over ground exhibits poor performance when compared to other configurations. One meter in the 2-MHz frequency range equates to λ/150 above ground. The design can be scaled by a factor s, where f'=sf, σ'=sσ, r'=r/s, h'=h/s, and l'=l/s. This assumes $\varepsilon_r=\varepsilon_{Dielectric}-j\sigma/\varepsilon_0\omega$. The efficiency and gain will increase for higher HF frequencies. The efficiency, vertical gain, peak surface wave, impedance, and dipole length were calculated for several conductivities (σ) for each model. The 3-D electromagnetic simulator was used to compute the antenna patterns for σ=0.1 for all the models. The 2-MHz skin depth δ was calculated for the same conductivities. For the two-dipole array model, two dipoles are placed end to end with the feed points separated by λ/2. This introduces an interference null on the axis of the dipoles in the two-dipole array model.

Regarding the single dipole model, the antenna pattern of a dipole in free space is very different than a dipole over real ground. The dipole in free space has a null along the axis of the dipole. A horizontal dipole over perfect ground requires an image dipole to meet the perfect ground boundary condition ($E_{||}=0$); the horizontal dipole over perfect ground does not have a surface wave (null at 0° elevation). The x-y-z coordinate system used herein puts (perfect) ground interface at z=0, region z>0 is free space, and region z≤0 is real ground where $\varepsilon_r=1$ with a range on conductivities. For purposes of this comparison, all the dipole antennas are assumed to be parallel to the x-axis. For the model of the single horizontal dipole and the model of the two-dipole array, the conducting elements are assumed to be perfectly conducting wires with a 2-millimeter diameter. The antenna length is adjusted to create a resonance at 2 kHz. EZNEC-Pro4®'s NEC4 double precession was used as the computational engine with a constant segment length that is 6 cm.

Figure 3:
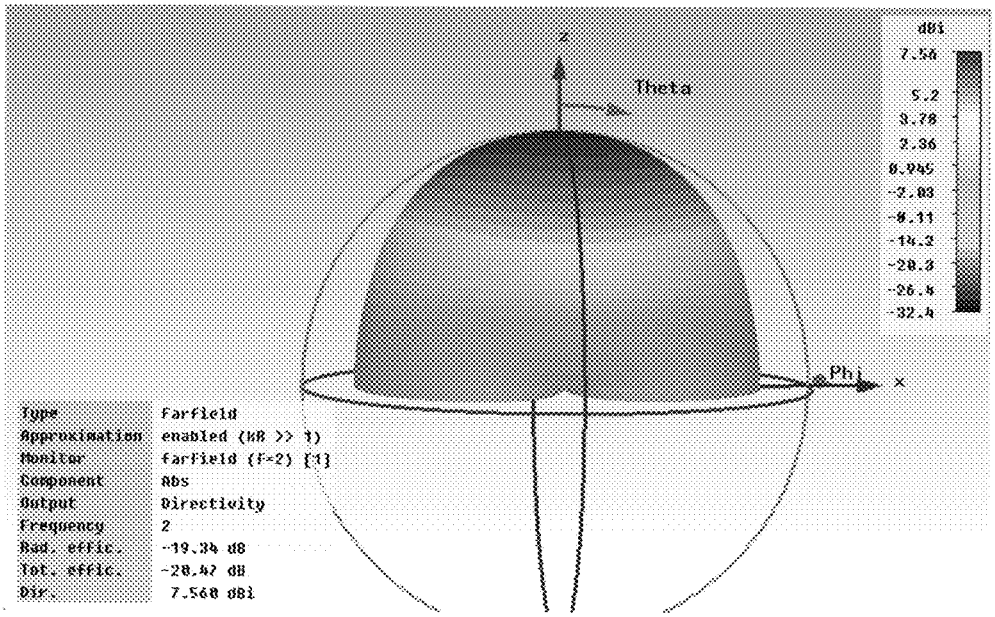
FIG. 3 is a computer simulated antenna pattern for a dipole antenna.
Figure 4:
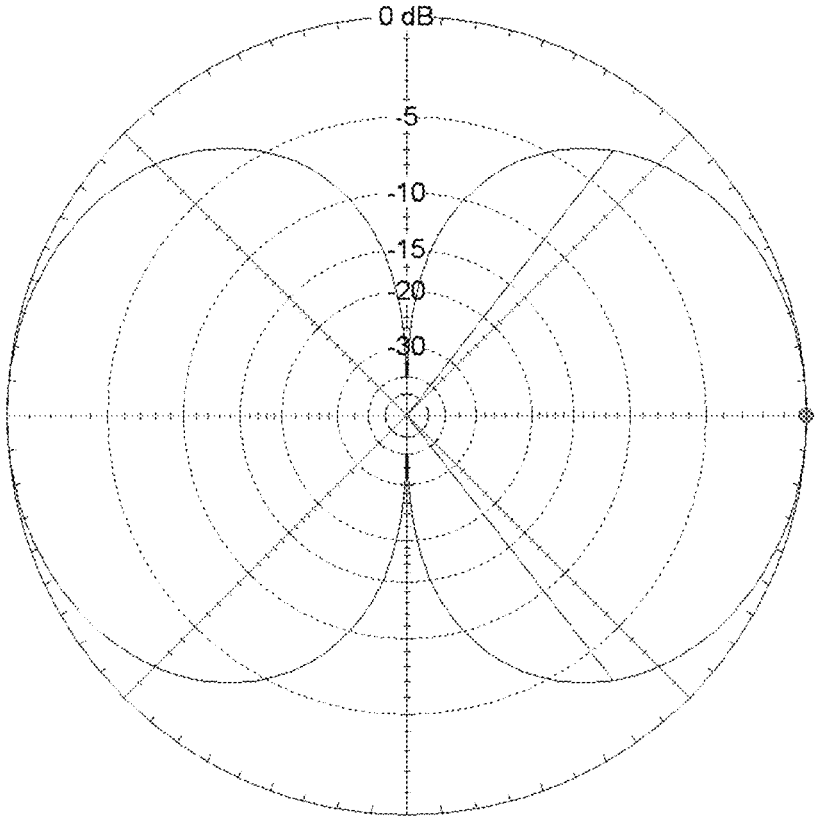
FIG. 4 is a plot of the ground/surface wave for a horizontal dipole antenna.

FIG. 3 is the antenna pattern for the single dipole model for σ=0.1. If the ground plane 18 has a finite conductivity, the null at 0° elevation is no longer present; the null at 0° elevation is reduced to a null in the y-axis direction. The NEC and CST efficiency and directivity agree within 0.3 decibels. The CST impedance, 30.1+j0.18, also agrees with NEC. FIG. 4 shows the EZNEC surface wave at 1 kilometer with the null in the y-axis direction. The horizontal dipole was evaluated at 1-meter height above ground at several different conductivities. The resulting efficiency, vertical gain, peak surface wave, impedance, and dipole length for each conductivity are shown in Table 1 below.

TABLE 1

Horizontal dipole height of 1 m.

| Conductivity (σ) | Efficiency (dB) | Peak Gain (dB) | Peak Directivity Gain (dBi) | Peak GW (1 km in dB) | Z (Ω) | Length (m) |
|---|---|---|---|---|---|---|
| Perfect | 0 | 9.03 | 9.03 | 0 | 0.105 − j 0.93 Ω | 74.58 |
| 0.1 | −19.62 | −11.86 | 7.76 | −20.30 | 31.8 + j 0.118 | 70.30 |
| 0.01 | −16.27 | −9.34 | 6.93 | −14.14 | 57.3 − j 1.29 | 69.66 |
| 0.001 | −13.58 | −6.83 | 6.75 | −17.23 | 103.5 − j 0.58 | 68.46 |
| 0.0001 | −13.25 | −6.57 | 6.68 | −19.76 | 109.1 − j 0.84 | 68.58 |

The efficiency increases with lower conductivity and larger skin depth δ as can be seen in Table 2 below. The surface conductivity can be approximate with the quantity σδ. The surface conductivity is unchanged for σ≤0.001; likewise, the efficiency remains about the same. On the other hand, the surface wave is decreased for σ≤0.001. The surface wave is not a significant source of the loss.

TABLE 2

Skin depth.

| Conductivity (σ) | Skin Depth (δ) | Surface Conductivity (σδ) |
|---|---|---|
| $\frac{1}{\Omega m}$ | M | $\Omega^{-1}$ |
| 0.1000 | 3.76 | 0.3760 |
| 0.01 | 18.18 | 0.1818 |
| 0.0010 | 168 | 0.1680 |
| 0.0001 | 1677 | 0.1677 |

The conventional calculation of skin effect is modified for $\varepsilon_r=10$. Where $\varepsilon_r$ is the relative dialectic constant and where $\varepsilon_r=1$ for free space. The ground is a poor conductor; this correction is significant. The square of the index of refraction is $$n^2 = 10 - j\frac{\sigma}{\varepsilon_0\omega}, \quad \text{Eq. 1}$$

Where ω is the angular frequency, σ is conductivity, $\varepsilon_0=10^7/4\pi c^2$, and c is the speed of light. This is using R. P. Feynman convention $\nabla\cdot E=\rho/\varepsilon_0$ where ∇ is the gradient and E is the electric field vector. The propagation in the material decays as $e^{-kz*imag(n)}$. The skin depth is:

$$\delta = \frac{c}{\omega * \text{imag}(n)}. \quad \text{Eq. 2}$$

When the horizontal dipole antenna height is increased to 4 m, the efficiency dramatically improves as can be seen in Table 3 below. In this case, the efficiency increases with higher conductivity. The higher efficiency greatly reduced the resistance. The perfect ground case was also computed for reference.

TABLE 3

Horizontal dipole height of 4 m.

| Conductivity (σ) | Efficiency (dB) | Peak Gain (dB) | Peak Directivity Gain (dBi) | Peak GW (1 km in dB) | Z (Ω) | Length (m) |
|---|---|---|---|---|---|---|
| Perfect | 0 | 9.01 | 9.01 | 0 | 1.66 − j 0.061 | 72.98 |
| 0.1 | −8.04 | −0.63 | 8.67 | −17.42 | 14.21 + j 1.38 | 72.50 |
| 0.01 | −9.64 | −1.6 | 8.04 | −12.04 | 34.9 − j 0.78 | 72.48 |
| 0.001 | −10.33 | −3.01 | 7.32 | −15.84 | 75.3 + j 0.028 | 71.94 |
| 0.0001 | −11.13 | −4.06 | 7.07 | −18.17 | 86.5 + j 0.26 | 68.58 |

FIG. 4 shows a representation of the ground/surface wave for the horizontal dipole model at σ=0.01. The surface wave is shown at 1 kilometer with the null in the y-axis direction.

Figure 5A:
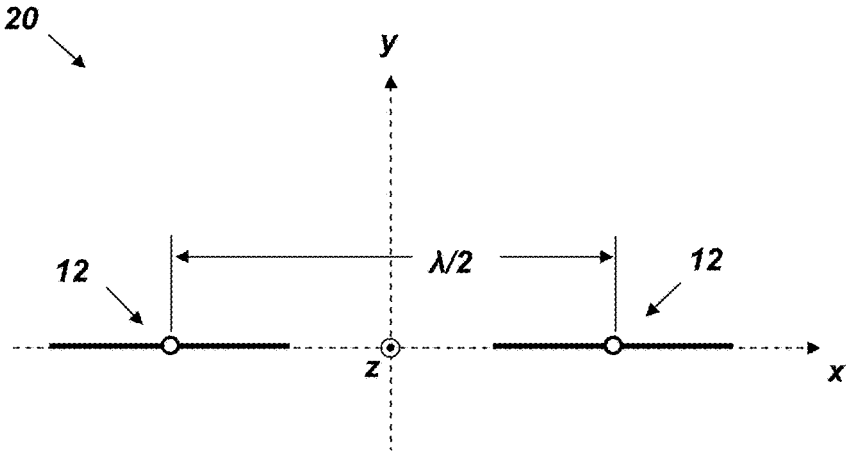
FIG. 5A is a top-view illustration of an end-to-end, two-dipole antenna array.
Figure 5B:
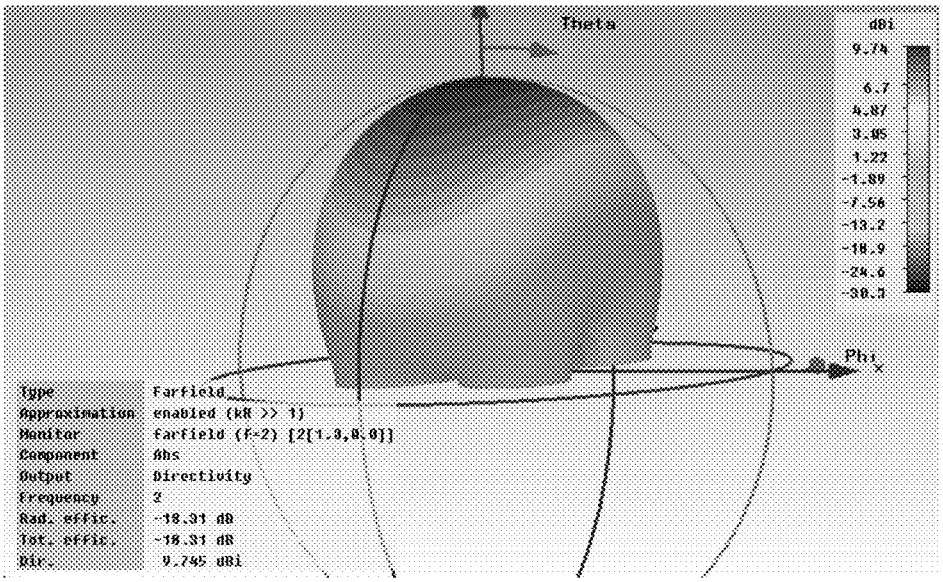
FIG. 5B is a computer-simulated antenna pattern for an end-to-end, two-dipole antenna array.

FIGS. 5A and 5B show an illustration of an end-to-end, two-dipole array 20 and its antenna pattern respectively. The gain in an antenna array pattern is caused by the interference of the radiation in the far field. The total power radiated from the antenna is a constant; the destructive interference removes power density from one part of the pattern and constructive interference adds power density to a different part of the pattern. FIG. 5A shows two dipoles placed end to end with a feed point separation of λ/2. The dipoles will strongly interfere along the x-axis of the dipoles as can be seen in FIG. 5B, which shows the antenna pattern for σ=0.1 for the two-dipole array 20. Note the deep null. The null allows the gain on the z-axis to be higher.

The simulation results for the two-dipole array 20 are presented in Table 4 below.

TABLE 4

Simulation results for two-dipole array.

| Conductivity (m/Ω) | Efficiency (dB) | Peak Gain (dB) | Peak Isotropic Gain (dBi) | Peak GW (1 km in dB) | Z (Ω) | Length (m) |
|---|---|---|---|---|---|---|
| 0.1000 | −18.58 | −8.86 | 9.72 | −24.68 | 31.9 + j 0.58 | 72.30 |
| 0.0100 | −15.59 | −6.31 | 9.28 | −18.51 | 57.0 − j 0.86 | 69.66 |
| 0.0010 | −12.86 | −3.82 | 9.04 | −21.7 | 103.5 − j 0.81 | 68.34 |
| 0.0001 | −12.57 | −3.63 | 8.94 | −24.23 | 111.0 + j 1.15 | 68.58 |

The two-dipole array 20 increases the efficiency over the single dipole model by a fraction of 1 decibels. The peak directivity is improved by about 2.2 decibels. The peak gain is increased by 3 decibels. The ground wave for the two-dipole array 20 was reduced by 4.3 decibels. In addition, for σ≤0.001, the efficiency is about the same, but the ground wave is still decreasing. This is the same data pattern seen in the single-dipole case. The ground wave is not a significant source of the loss.

Figure 6:
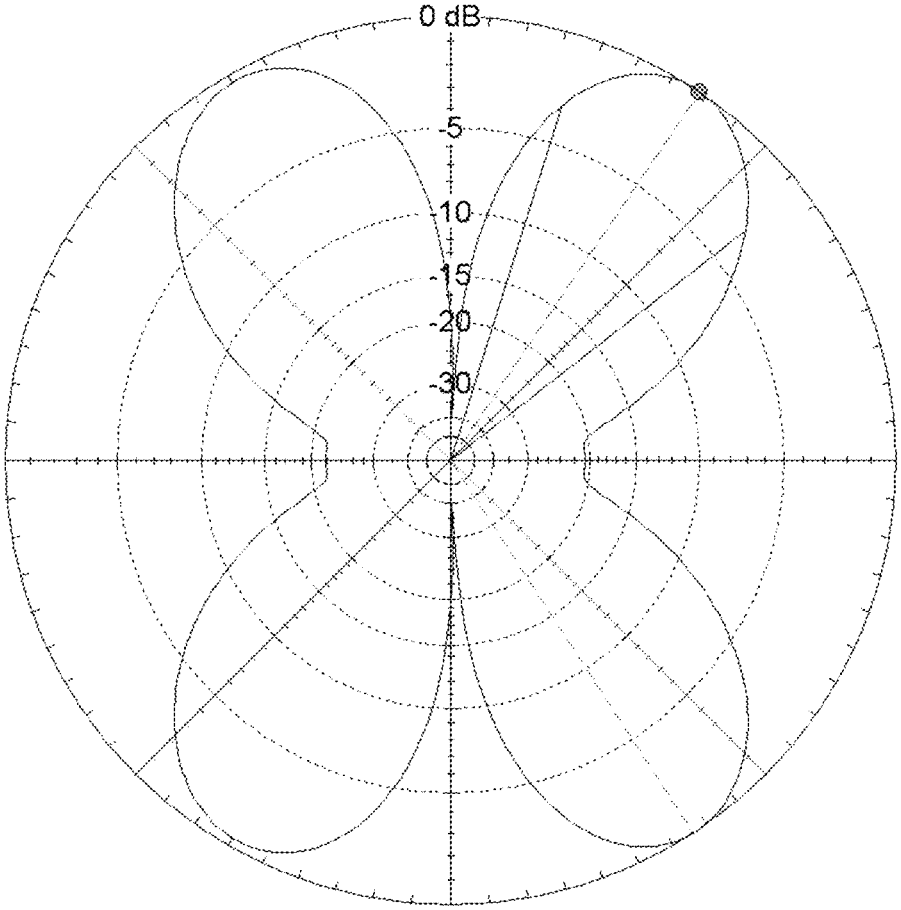
FIG. 6 is an illustration of the ground wave for a two-dipole array.

FIG. 6 is an illustration of the ground wave for the two-dipole array 20 with σ=0.1. Note the additional null in the ground wave pattern as compared to the surface wave for the single dipole shown in FIG. 4. This extra null is caused by the interference in the x-direction. One approach is to use two parallel dipoles at a distance λ/2 to increase the array gain. When the parallel dipoles are very close to ground, the array gain is not increased. The interference in the y-direction deepens the existing null; this has a small impact on the pattern and the peak isotropic gain. On the other hand, two parallel dipoles in free space with a λ/2 separation will destructively interfere in the plane of the dipoles and constructively interfere normal to the plane of the dipoles. The free space gain is increased by 3 decibels.

Table 5 below lists the calculated efficiency, vertical gain, peak surface wave, impedance, and dipole length of the NVIS antenna 10 for several conductivities at 1-meter height. The geometry of the NVIS antenna 10, as shown in FIGS. 1 and 2, reduces the side lobes when the antenna beam is pointed.

TABLE 5

(h = 1 m)

| σ (m/Ω) | Efficiency (dB) | Peak Gain (dB) | Peak Isotropic Gain(dBi) | Peak GW (1 km in dB) | Z for $12_a$ & $12_b$ (Ω) | Z for $12_c$ & $12_d$ (Ω) | Length (m) |
|---|---|---|---|---|---|---|---|
| 0.1 | −15.86 | −5.95 | 9.91 | −22.98 | 32.68 − j 1.76 | 32.22 − j 1.73 | 72.18 |
| 0.01 | −12.91 | −3.45 | 9.46 | −16.94 | 58.39 + j 1.81 | 58.39 + j 1.61 | 69.78 |
| 0.001 | −10.22 | −0.60 | 9.21 | −20.23 | 109.2 − j 3.26 | 107.4 − j 12.69 | 69.40 |
| 0.0001 | −9.58 | −0.60 | 8.98 | −22.21 | 122.5 + j 8.24 | 100.8 + j 14.97 | 69.30 |

In an example embodiment of the NVIS antenna 10, the spacing between the feed points 16 of the dipoles $\mathbf{12}_c$ and $\mathbf{12}_d$ is 105.96 meters, the spacing between the feed points 16 of the dipole antennas $\mathbf{12}_a$ and $\mathbf{12}_b$ is 35 meters, and the height of the conductive elements 14 over ground 18 is 1 meter. In this embodiment, the antenna length may be adjusted to move the resonant frequency to 2 MHz. Compared to simulated results of the two-dipole array 20, the efficiency of the NVIS antenna 10 is 2.6 to 3 decibels higher, the peak directivity is increased by 0.2 decibels, the peak gain increased by 2.8 to 3 decibels, and the ground wave is increased by 2 to 3.4 decibels. The ground wave amplitude is not correlated with efficiency. The ground wave plays an insignificant role in the efficiency.

Figure 7A:
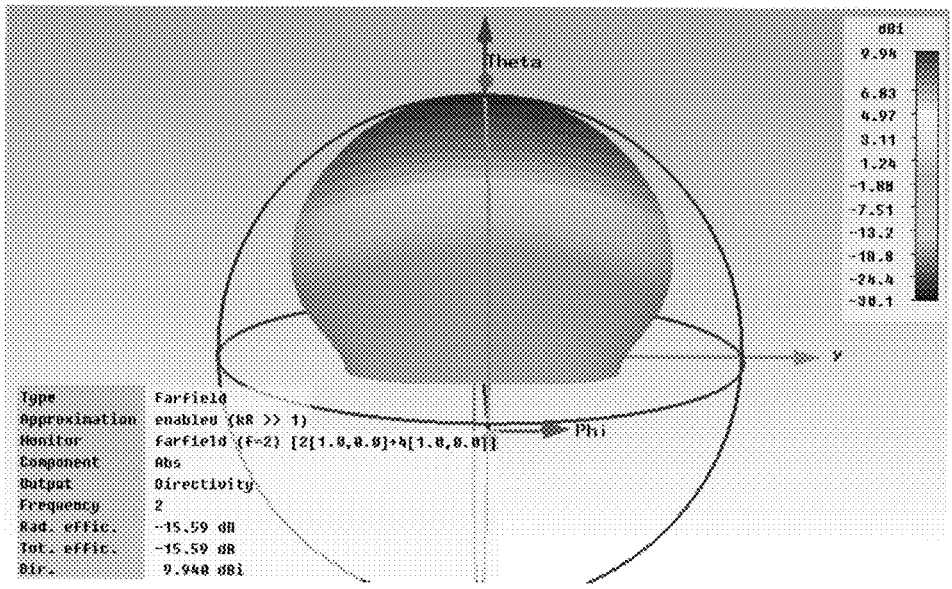
FIG. 7A shows the directivity pattern for an embodiment of an NVIS antenna when viewed from the x-axis.
Figure 7B:
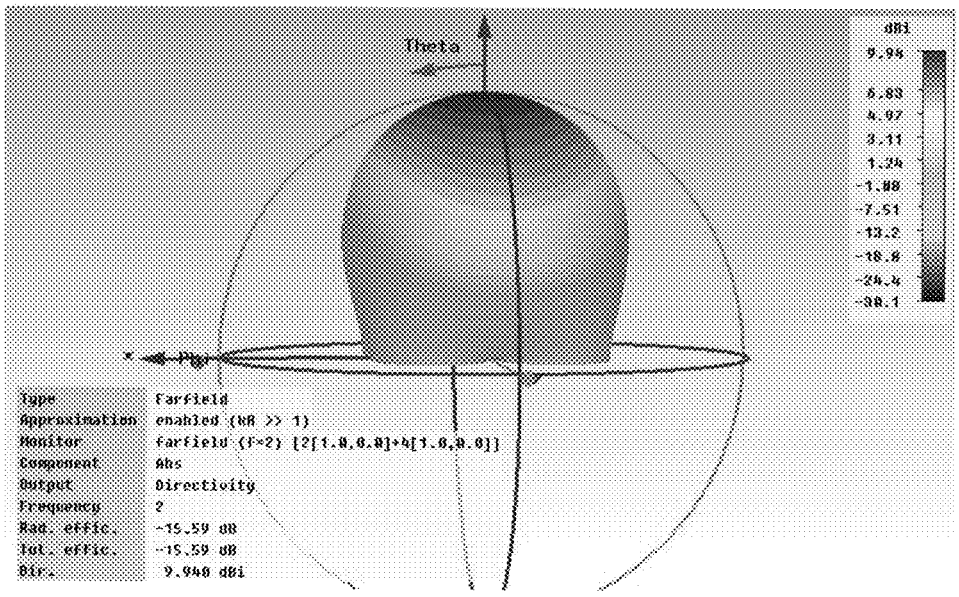
FIG. 7B shows the directivity pattern for an embodiment of an NVIS antenna when viewed from the y-axis.
Figure 8:
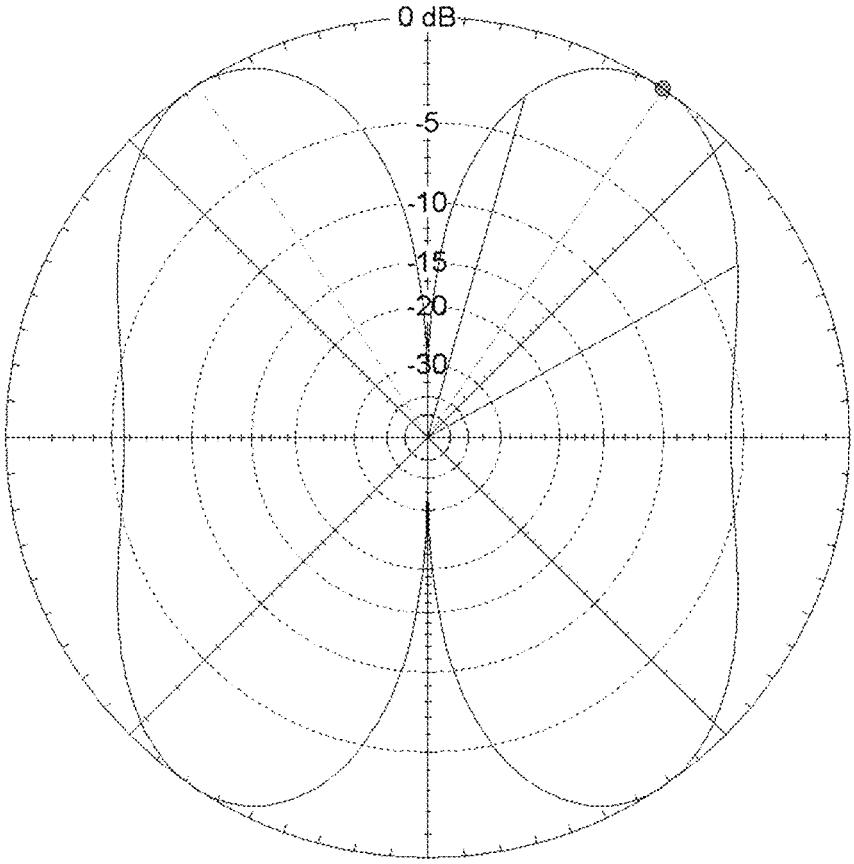
FIG. 8 shows the ground wave plot for an embodiment of an NVIS antenna.

FIGS. 7A and 7B show the directivity pattern when viewed from the x-axis and the y-axis respectively for the embodiment of the NVIS antenna 10 described above where σ=0.1. FIG. 8 shows the ground wave plot for the NVIS antenna 10 where σ=0.1. The ground wave plot in FIG. 8 shows a deep null on the y-axis. The x-axis has a shallow null. The computed CST directivity and NEC have a 0.03 decibels isotropic difference. The efficiencies differ by 0.27 decibels.

The antenna pattern of the NVIS antenna 10 may be pointed in the x-direction by applying a phase θ to dipole $\mathbf{12}_d$ and a phase −θ to dipole $\mathbf{12}_c$. The following parameters for σ=0.01 and a range of angles θ for the NVIS antenna 20 are listed in Table 6 below: efficiency, peak gain, angle of peak gain, peak ground wave, and typical impedance. Dipole $\mathbf{12}_c$ and $\mathbf{12}_d$ have different impedances; only one is given in column 7

TABLE 6

Directivity for σ = 0.01.

| Phase (°) | Efficiency (dB) | Peak Gain (dB) | Angle (°) | Peak GW (1-km dB) | Z for $12_c$ or $12_d$ C (Ω) | Z for $12_a$ or $12_b$ S Ω |
|---|---|---|---|---|---|---|
| 0 | −12.91 | −3.45 | 90 | −16.94 | 58.39 + j 1.81 | 58.4 + j 1.81 |
| 10 | −12.93 | −3.46 | 87 | −15.72 | 58.24 + j 1.96 | 60.2 + j 0.37 |
| 20 | −12.99 | −3.52 | 84 | −14.60 | 58.07 + j 2.07 | 60.1 + j 0.37 |
| 30 | −13.10 | −3.62 | 81 | −13.58 | 57.9 + j 2.13 | 60.1 + j 0.35 |
| 40 | −13.24 | −3.75 | 78 | −12.65 | 57.73 + j 2.14 | 59.95 + j 0.33 |
| 50 | −13.44 | −3.92 | 72 | −11.79 | 57.58 + j 2.13 | 59.8 + j 0.31 |
| 60 | −13.69 | −4.12 | 69 | −11.01 | 57.45 + j 2.08 | 59.7 + j 0.29 |
| 70 | −13.99 | −4.37 | 66 | −10.29 | 57.35 + j 2.03 | 59.6 + j 0.26 |
| 80 | −14.36 | −4.65 | 63 | −9.63 | 57.27 + j 1.97 | 59..4 + j 0.23 |

TABLE 6-continued

| Directivity for σ = 0.01. | | | | | | |
|---|---|---|---|---|---|---|
| Phase (°) | Efficiency (dB) | Peak Gain (dB) | Angle (°) | Peak GW (1-km dB) | Z for $12_c$ or $12_d$ C (Ω) | Z for $12_a$ or $12_b$ S Ω |
| 90 | −14.79 | −4.98 | 60 | −9.04 | 57.21 + j 1.91 | 59.2 + j 0.20 |
| 100 | −15.29 | −5.36 | 57 | −8.58 | 57.16 + j 1.87 | 59.1 + j 0.17 |
| 110 | −15.86 | −5.78 | 51 | −8.26 | 57.12 + j 1.82 | 58.9 + j 0.15 |
| 120 | −16.50 | −6.25 | 48 | −8.08 | 57.07 + j 1.79 | 58.8 + j 0.12 |

A±70° input phase shift will point the pattern 24° off vertical or at 66° elevation with only a 1-decibels loss in gain and efficiency. The impedance in Table 6 has a very small variation.

Table 7 computes the dipole array performance for ±70° phase and a range of conductivities. CST was used to model the NVIS antenna 10 with ground conductivity σ=0.1.

TABLE 7

| Input with ± 70° phase. | | | | | | |
|---|---|---|---|---|---|---|
| σ | Efficiency (dB) | Peak Gain (dB) | Angle (°) | Peak GW (1 km in dB) | Z for $12_c$ or $12_d$ C (Ω) | Z for $12_a$ or $12_b$ S (Ω) |
| 0.1 | −17.29 | −7.24 | 69 | −16.44 | 3.31 − j 1.67 | 32.3 − j 2.16 |
| 0.01 | −13.99 | −4.37 | 66 | −10.29 | 57.4 + j 2.03 | 59.6 + j 0.26 |
| 0.001 | −11.30 | −1.73 | 66 | −13.35 | 104 + j 0.2615 | 105.3 − j 7.37 |
| 0.0001 | −10.63 | −1.25 | 66 | −15.43 | 119.9 + j 24.7 | 98.5 − j 9.62 |

Figure 9A:
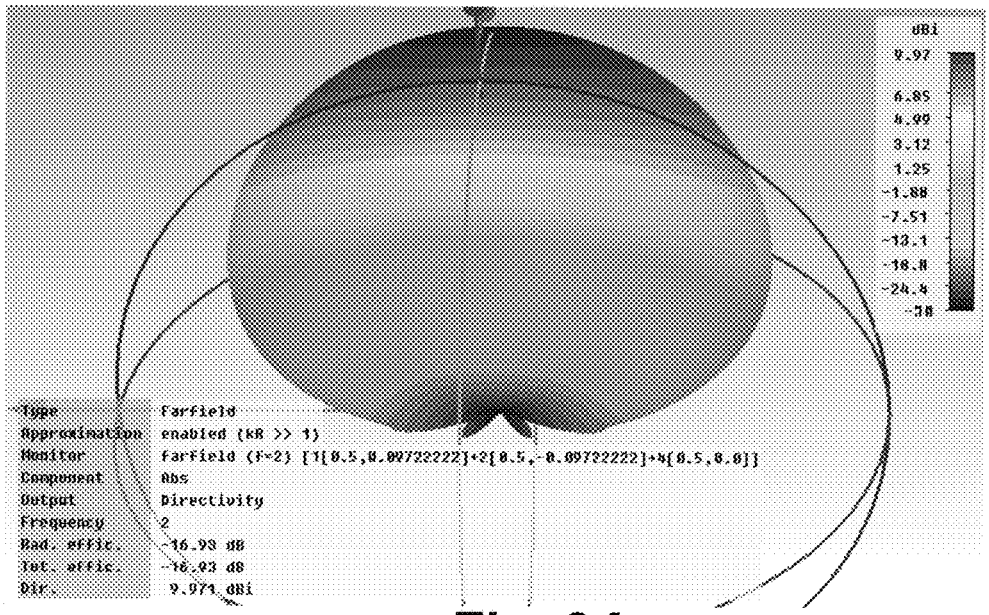
FIGS. 9A and 9B are illustrations of the 3-D antenna pattern for an embodiment of an NVIS antenna pointed at 66° elevation.
Figure 9B:
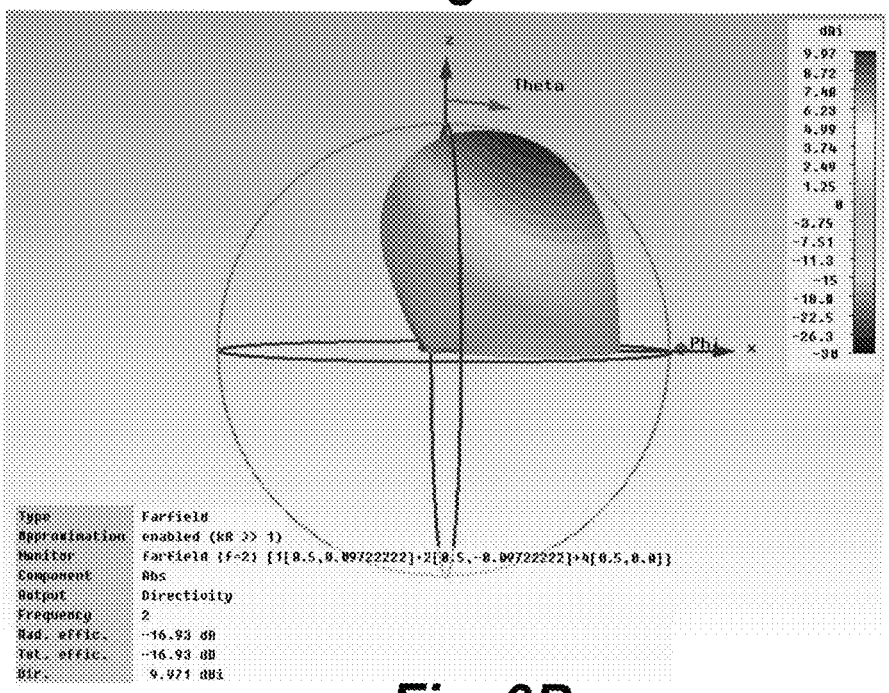

FIGS. 9A and 9B are illustrations of the 3-D antenna pattern for the NVIS antenna 10 pointed at 66° elevation. In FIG. 9A, the 3-D antenna pattern is rotated to show the very small (−20 decibels isotropic) side lobes of the antenna. In FIG. 9B, the 3-D antenna pattern is viewed from the side to show the small null on the y-axis.

Figure 10:
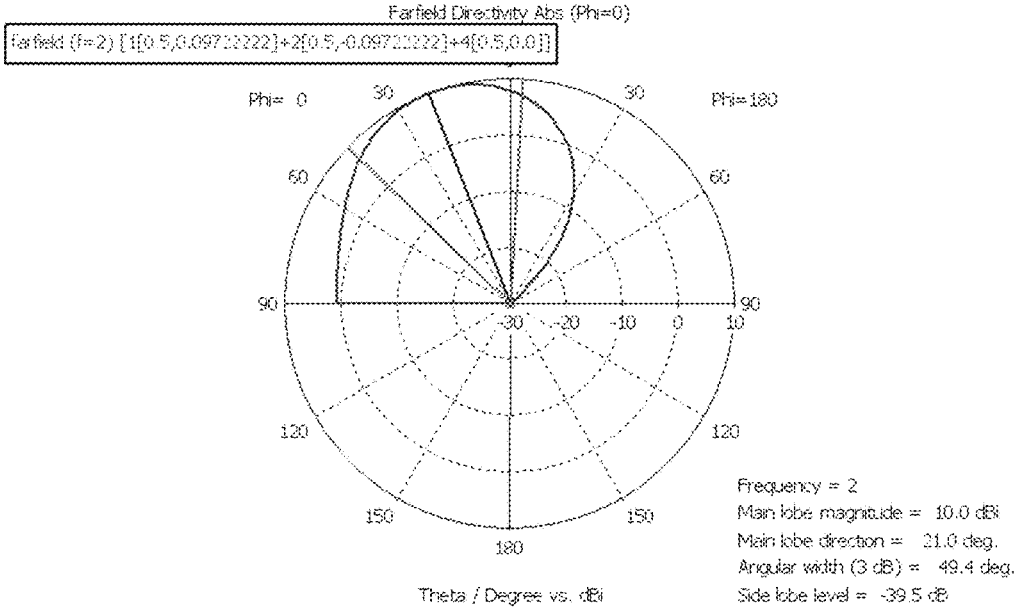
FIG. 10 is an elevation slice on the x-axis of the antenna pattern of an embodiment of an NVIS antenna.

FIG. 10 is an elevation slice on the x-axis of the antenna pattern of the NVIS antenna 10. The 3-decibels width of elevation cut is 49.4°. The main lobe magnitude is 10.0 dBi. The main lobe direction is 21°. The side lobe level is −39.5 dB.

Figure 11:
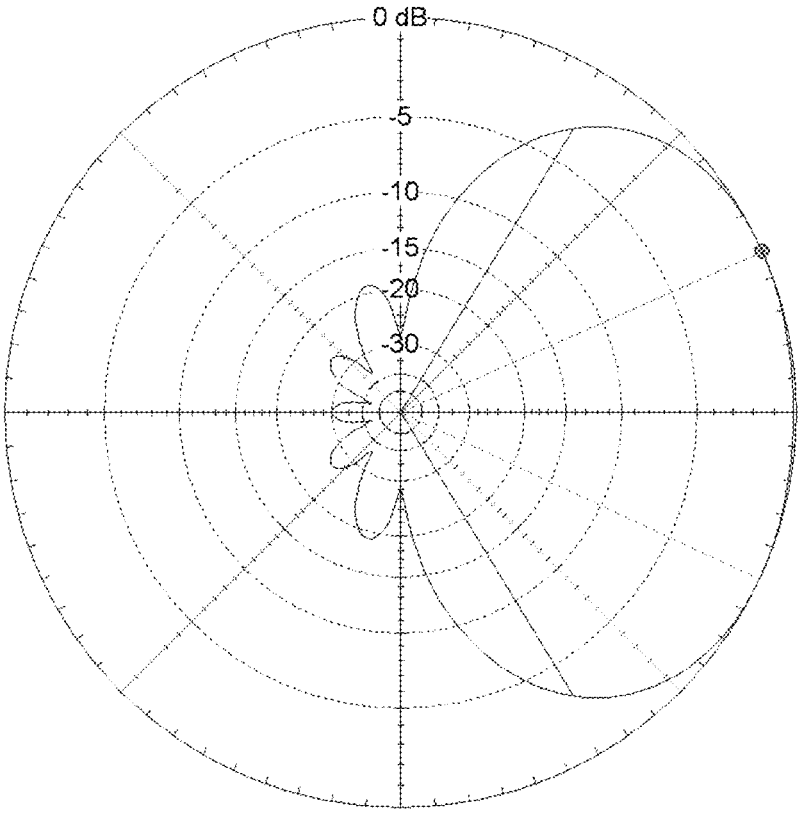
FIG. 11 is a plot of the ground wave of an embodiment of an NVIS antenna at 1 kilometer.

FIG. 11 is a plot of the ground wave of the NVIS antenna 10 at 1 kilometer. The 0-decibels reference level is −9.63 decibels. Pointing the beam 24° to the side reduced the efficiency and gain by about 1 decibels. The peak ground wave is increased by a much larger 6.65 decibels. The variation in impedance between 0° to 70° phase is small for σ≥0.01, with only a small percentage change in the feed point reflection. A change in pointing angle would not require retuning. The EZNEC® and CST directives agree within 0.03 decibels, and the efficiency differs by 0.36 decibels.

The NVIS antenna 10 can be pointed in one direction to allow better performance. The NVIS antenna 10 may be angled relative to the x-axis. The power into each dipole 12 may have a unique weight. In an embodiment of the NVIS antenna 10, the NVIS antenna 10 may further comprise a matching network and at least one of the dipole antennas is operated below resonance (i.e., shorter than ½ λ). The impedance is almost constant for a wide range of input phase shifts. The improvement in efficiency is not correlated with the peak ground wave amplitude; the ground wave is not the primary loss mechanism. The primary loss mechanism is the ground currents caused by the near fields.

Table 8 below lists the calculated efficiency and dipole length of the NVIS antenna 10 for two different conductivities at 4-meter height.

TABLE 8

| (NVIS Antenna, h = 4 m) | | |
|---|---|---|
| σ (m/Ω) | Efficiency (dB) | Length (m) |
| 0.4 | −6.33 | 73.74 |
| 0.1 | −8.04 | 73.5 |

Figure 12A:
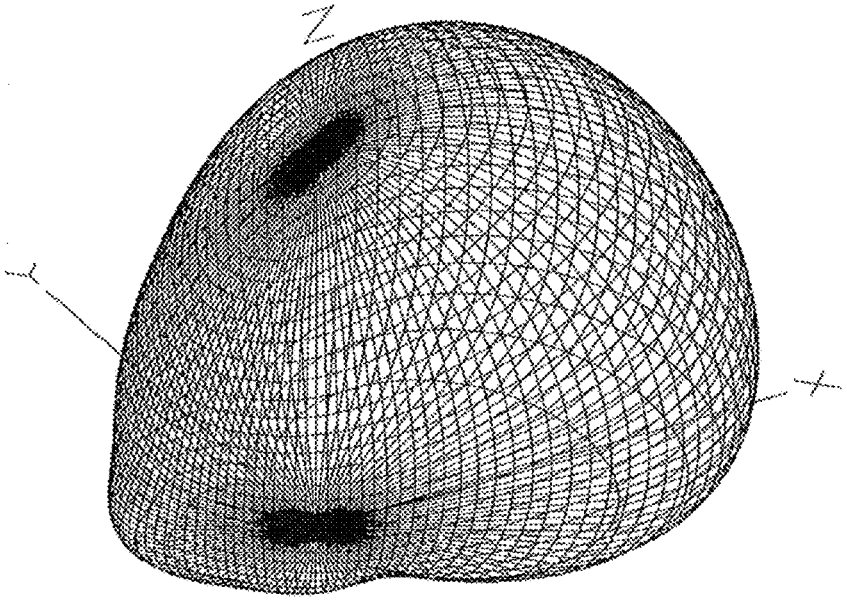
FIG. 12A is an illustration of the antenna pattern for a 10.8 km embodiment of an NVIS antenna.
Figure 12B:
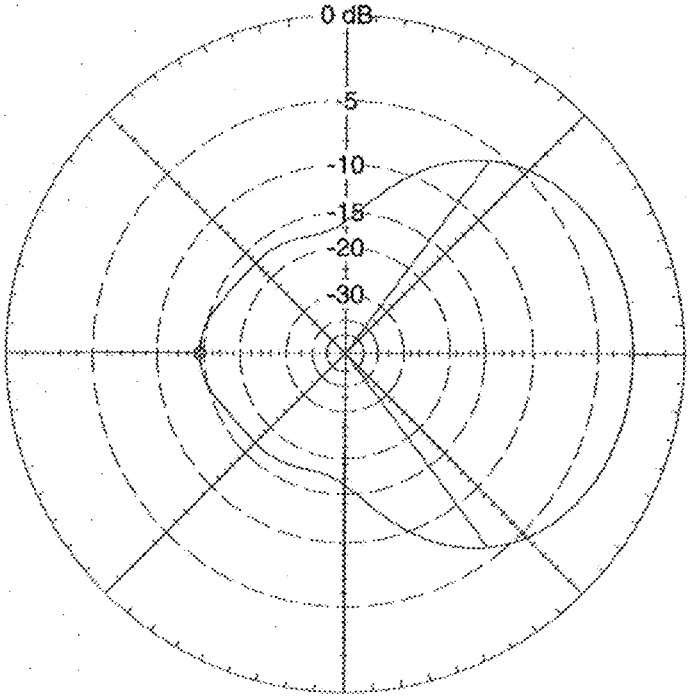
FIG. 12B is an azimuth plot for an antenna pattern for an embodiment of an NVIS antenna.

When a phase shift is added to the NVIS antenna 10 to point the beam, the spacing between the substantially parallel dipoles $\mathbf{12}_a$ and $\mathbf{12}_b$ may be adjusted to reduce one of the resulting side lobes that would typically appear in the antenna pattern. The spacing between end-to-end dipoles $\mathbf{12}_c$ and $\mathbf{12}_d$ may be adjusted to reduce one of the resulting back lobes that would typically appear in the antenna pattern. For example, FIG. 12A is an illustration of the antenna pattern for an embodiment of the NVIS antenna 10 for a low conductivity of 3e-5 where the dipoles 12 are 10.8 km long, the distance between the feed points 16 of dipoles $\mathbf{12}_a$ and $\mathbf{12}_b$ is 8 km and the distance between the feed points 16 of dipoles $\mathbf{12}_c$ and $\mathbf{12}_d$ is 35.4 km. At higher conductivity the nulls vanish but the pattern is similar. FIG. 12B is an azimuth plot for the same pattern as shown in FIG. 12A, but at 15 degrees elevation with a peak in the side lobe. The embodiment of the NVIS antenna 10 corresponding to FIGS. 12A and 12B has an efficiency of −17.77 dBi and a peak gain of −8.95 dBi.

Figure 13:
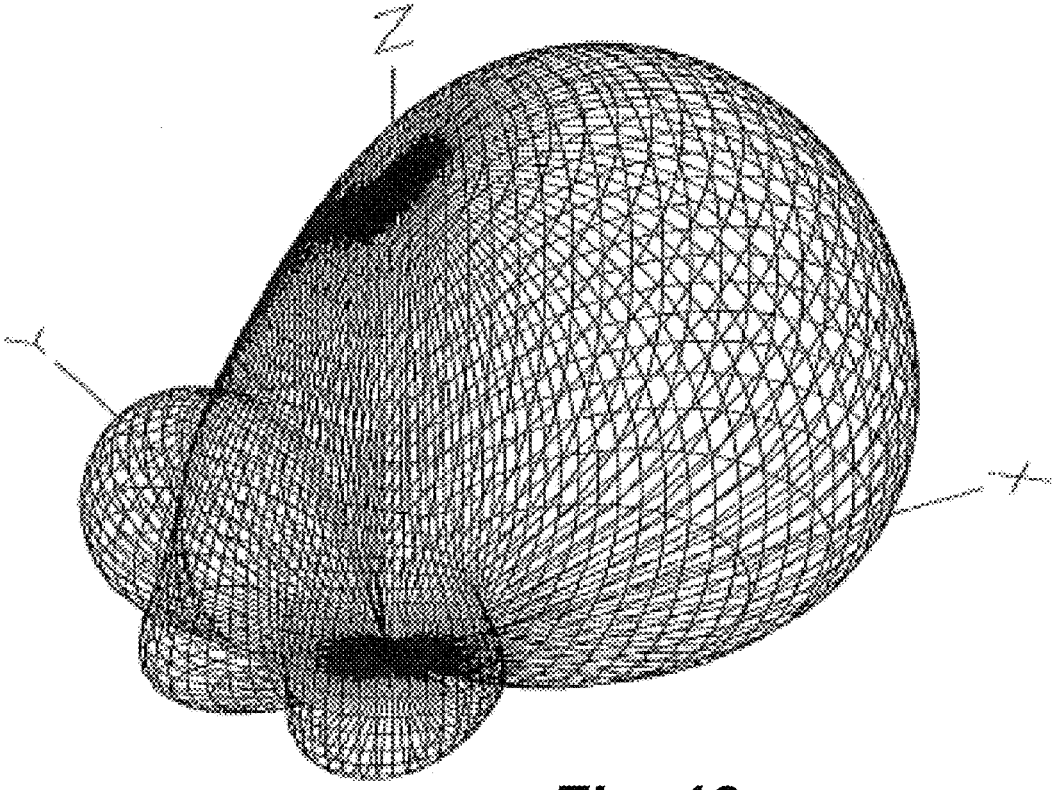
FIG. 13 is an illustration of an antenna pattern of an embodiment of an NVIS antenna.
Figure 14A:
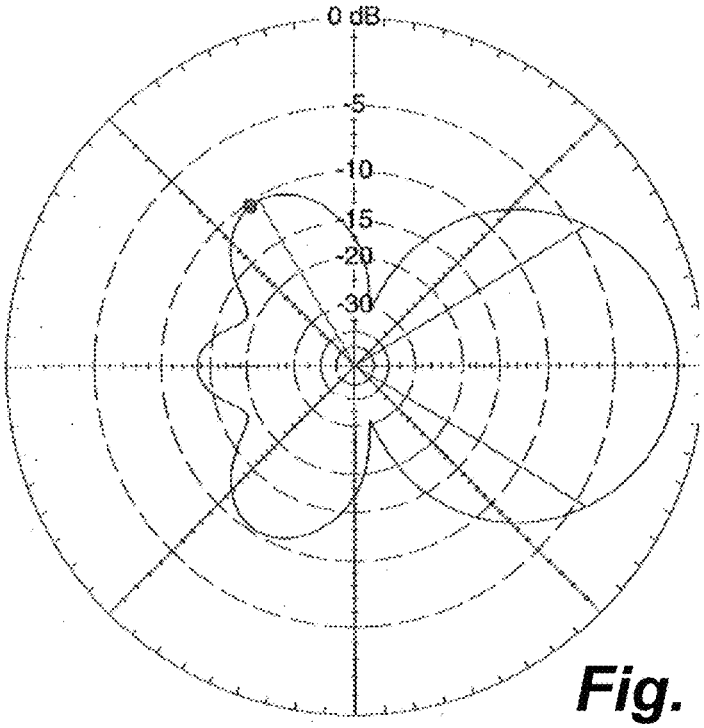
FIGS. 14A and 14B are azimuth plots of an embodiment of an NVIS antenna.
Figure 14B:
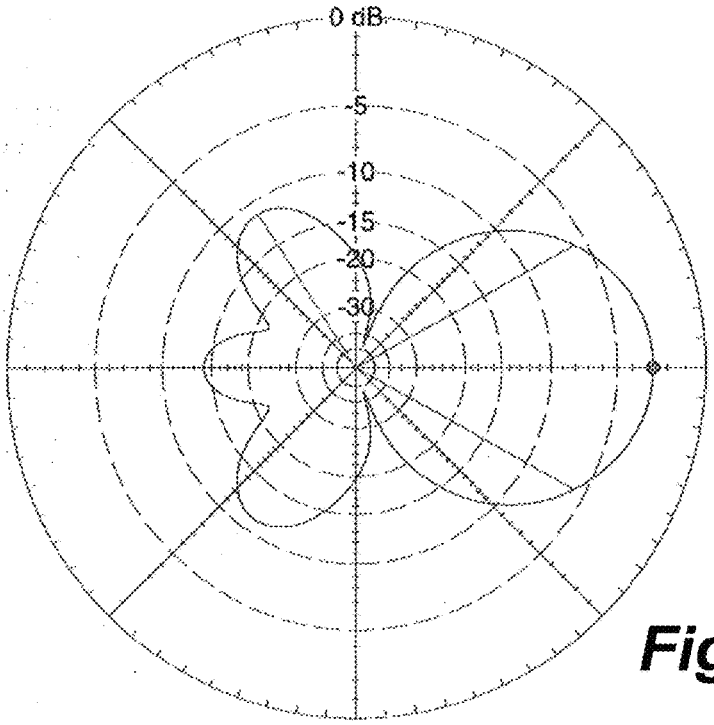

FIG. 13 is an illustration of an antenna pattern of the same NVIS antenna 10 embodiment corresponding to FIG. 12A but where the distance between the feed points 16 of dipoles $\mathbf{12}_a$ and $\mathbf{12}_b$ is 34 km. FIGS. 14A and 14B are azimuth plots of the NVIS antenna 10 embodiment of FIG. 13 at 27 degrees elevation and 15 degrees elevation respectively. Notice the peak in the side lobe in FIG. 14A. Table 9 lists some of the antenna properties associated with the NVIS antenna 10 of FIG. 14A.

TABLE 9

| (NVIS Antenna, 34 km separation, 27° elevation) | |
|---|---|
| Elevation Angle | 27.0 deg. |
| Outer Ring | −8.86 dBi |
| 3D Max Gain | −8.86 dBi |
| Slice Max Gain | −10.13 dBi @ Az Angle = 0.0 deg. |
| Front/Back | 12.26 dB |
| Beamwidth | 62.5 deg.; −3 dB @ 328.7, 31.2 deg. |
| Sidelobe Gain | −19.16 dBi @ Az Angle = 120.0 deg. |
| Front/Sidelobe | 9.03 dB |
| CursorAz | 123.0 deg. |
| Gain | −19.17 dBi, −9.04 dBmax, −10.31 dBmax3D |

Figure 15A:
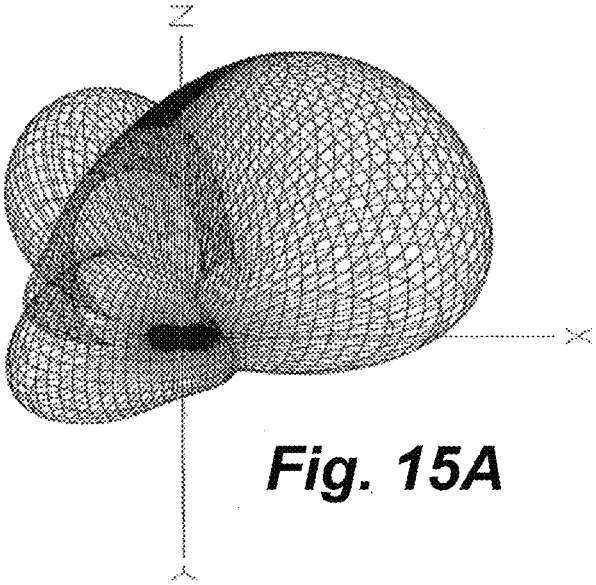
FIG. 15A is an illustration of an antenna pattern of an embodiment of an NVIS antenna.
Figure 15B:
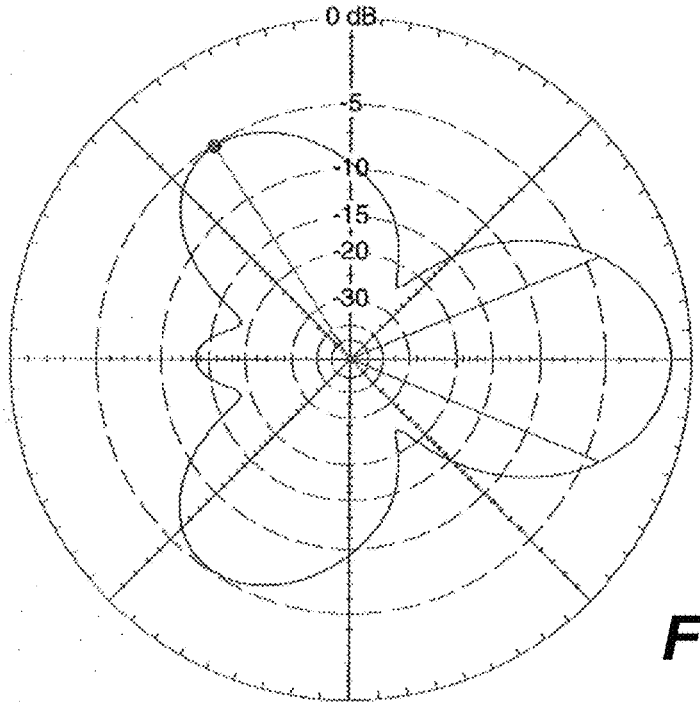
FIG. 15B is an azimuth plot of an embodiment of an NVIS antenna.

FIG. 15A is an illustration of an antenna pattern of the same NVIS antenna 10 embodiment corresponding to FIG. 12A but where the distance between the feed points 16 of dipoles $\mathbf{12}_a$ and $\mathbf{12}_b$ is 50 km. FIG. 15B is an azimuth plot of the NVIS antenna 10 embodiment of FIG. 15A at 30 degrees elevation with a peak in the side lobe. Table 10 lists some of the antenna properties associated with the NVIS antenna 10 of FIG. 15B.

TABLE 10

| (NVIS Antenna, 50 km separation, 30° elevation) | |
|---|---|
| Elevation Angle | 30.0 deg. |
| Outer Ring | −8.86 dBi |
| 3D Max Gain | −8.86 dBi |
| Slice Max Gain | −9.87 dBi @ Az Angle = 0.0 deg. |
| Front/Back | 12.44 dB |
| Beamwidth | 44.8 deg.; −3 dB @ 337.6, 22.4 deg. |
| Sidelobe Gain | −13.97 dBi @ Az Angle = 123.0 deg. |
| Front/Sidelobe | 4.1 dB |
| CursorAz | 123.0 deg. |
| Gain | −13.97 dBi, −4.1 dBmax, −5.11 dBmax3D |

Reducing the side lobes increases the efficiency from −19.56 dB to 17.77 dB.

Figure 16:
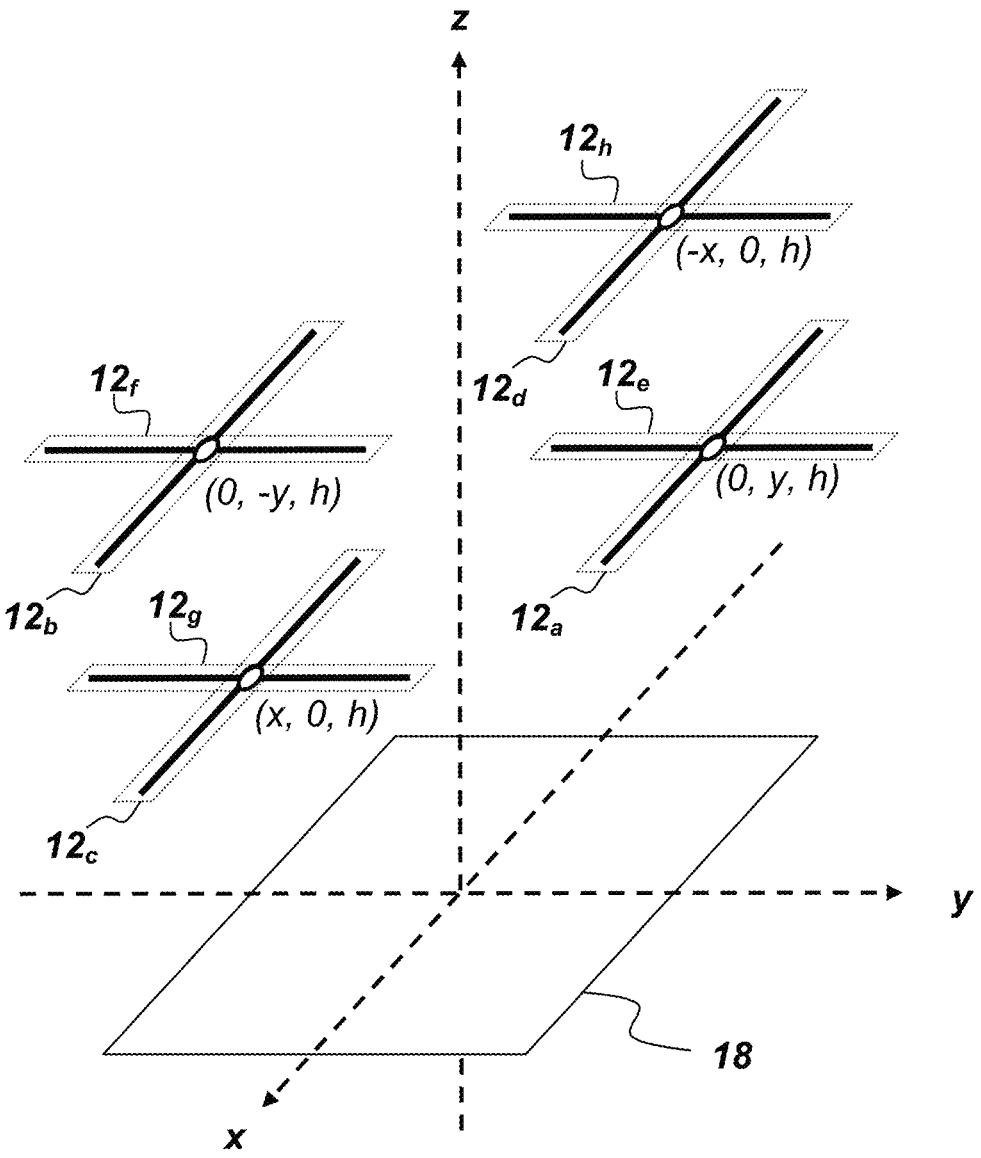
FIG. 16 is an illustration of an embodiment of an NVIS antenna.

The NVIS antenna 10 is capable of producing various types of polarized signals. For example, the NVIS antenna 10 shown in FIGS. 1 and 2 will produce a linearly polarized signal. FIG. 16 is an illustration of an embodiment of the NVIS antenna 10 that is capable of producing a circularly polarized signal. The embodiment of the NVIS antenna 10 shown in FIG. 16 comprises four more dipole antennas $\mathbf{12}_e$-$\mathbf{12}_h$ in addition to, and having the same dimensions as, the dipoles $\mathbf{12}_a$-$\mathbf{12}_d$ shown in FIGS. 1 and 2. Each of the additional dipoles $\mathbf{12}_e$-$\mathbf{12}_h$ is disposed at 90 degrees to one of the original four dipoles $\mathbf{12}_a$-$\mathbf{12}_d$. The RF input to the dipoles $\mathbf{12}_e$-$\mathbf{12}_h$ is shifted by 90° where the phase shift sign determines right or left circularly polarized signal such that the NVIS antenna 10 is capable of creating a circularly polarized signal. A small offset in antenna height would introduce a very small phase shift ($360*h_{Offset}/\lambda$. Typically $h_{Offset}<h$. The dipoles antennas $\mathbf{12}_a$-$\mathbf{12}_h$ may all be at the same height. The wires connecting to the feed points can be offset. The antennas are driven 90° out of phase. In this circularly-polarized embodiment, there is limited flexibility in the positioning of the antennas' x and y ranges from $\lambda/4$ to $\lambda/2$. The smallest spacing value is set by the dipole arm length$<\lambda/4$. This allows a small space between the dipole ends. For one circular polarization embodiment of the NVIS antenna 10 for VLF at 6 KHz, the efficiency was −24.7 dB and −22.5 dB, and the for the four sets of crossed dipoles 12, the right hand polarization vertical gain was much higher than the left hand vertical gain (i.e., −11.3 dB RH and −35 dB LH). By way of comparison, for two sets of crossed dipoles the gains are −14.3 dB RH and −26.6 dB LH. As a general principle, the antenna pattern of a circularly polarized embodiment of the NVIS antenna 10 will have elliptical polarization off axis. The circularly polarized embodiment of the NVIS antenna 10 can be pointed along either the x- or y-axis. This design can have symmetry. The antenna pattern of the NVIS antenna in FIG. 16 can pointed in the x-direction by applying a phase θ to dipole $\mathbf{12}_d$ and $\mathbf{12}_h$; and a phase −θ to dipole $\mathbf{12}_e$ and $\mathbf{12}_g$. For the y-direction, a phase θ is applied to dipole $\mathbf{12}_b$ and $\mathbf{12}_f$; and a phase −θ is applied to dipole $\mathbf{12}_a$ and $\mathbf{12}_e$.

Figure 17:
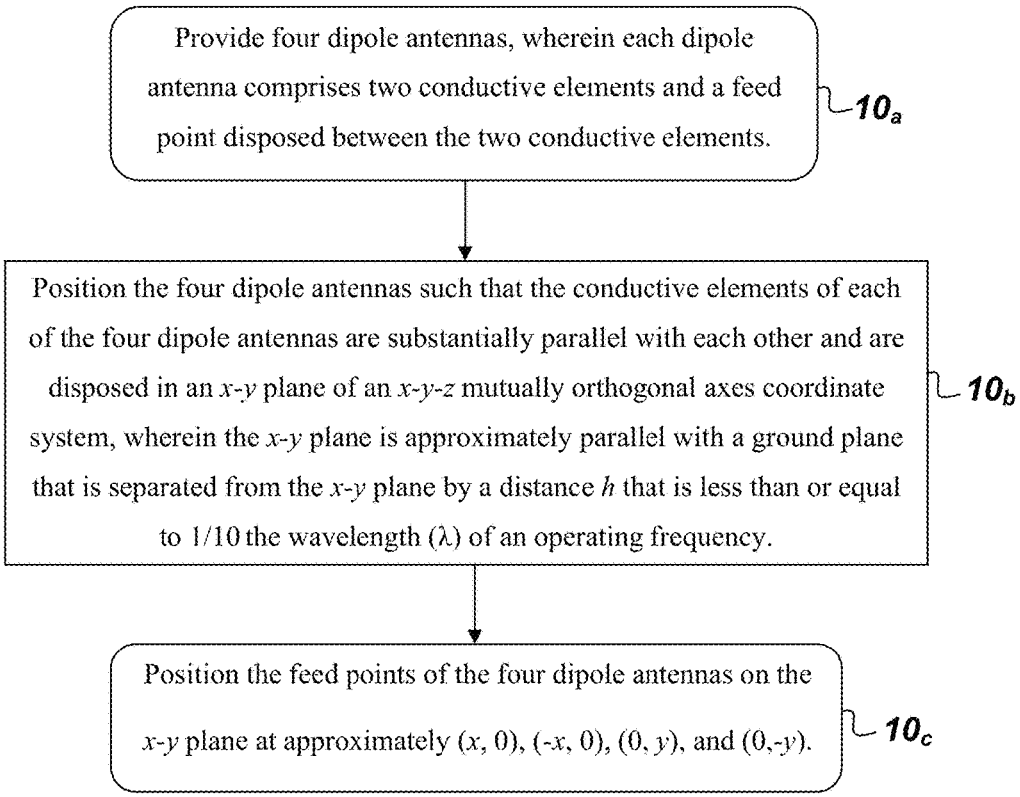
FIG. 17 is a flowchart of a method for providing an NVIS antenna.

FIG. 17 is a flowchart of a method 22 for providing the NVIS antenna 10. Step 24 involves providing four dipole antennas 12, wherein each dipole antenna 12 comprises two conductive elements 14 and a feed point 16 disposed between the two conductive elements 14. Step 26 provides for positioning the four dipole antennas 12 such that the conductive elements 14 of each of the four dipole antennas 12 are substantially parallel with each other and are disposed in an x-y plane of the x-y-z mutually orthogonal axes coordinate system. The x-y plane is approximately parallel with a ground plane that is separated from the x-y plane by a distance h that is less than or equal to 1/10 the wavelength (λ) of an operating frequency. Step 28 provides for positioning the feed points 16 of the four dipole antennas 12 on the x-y plane at approximately (x, 0), (−x, 0), (0, y), and (0, −y).

Figure 18A:
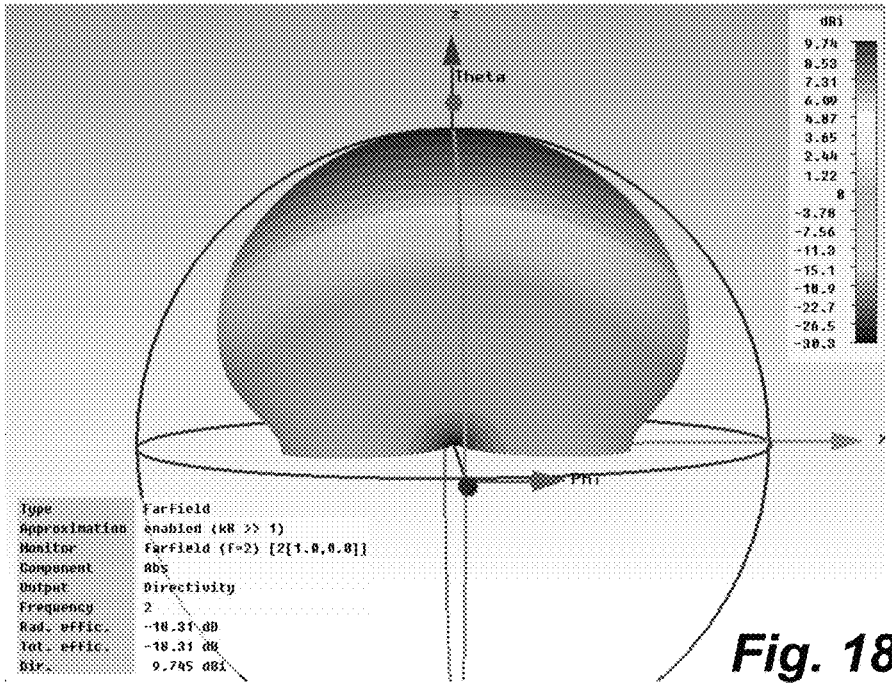
FIGS. 18A and 18B are illustrations of an antenna pattern of an embodiment of an NVIS antenna.
Figure 18B:
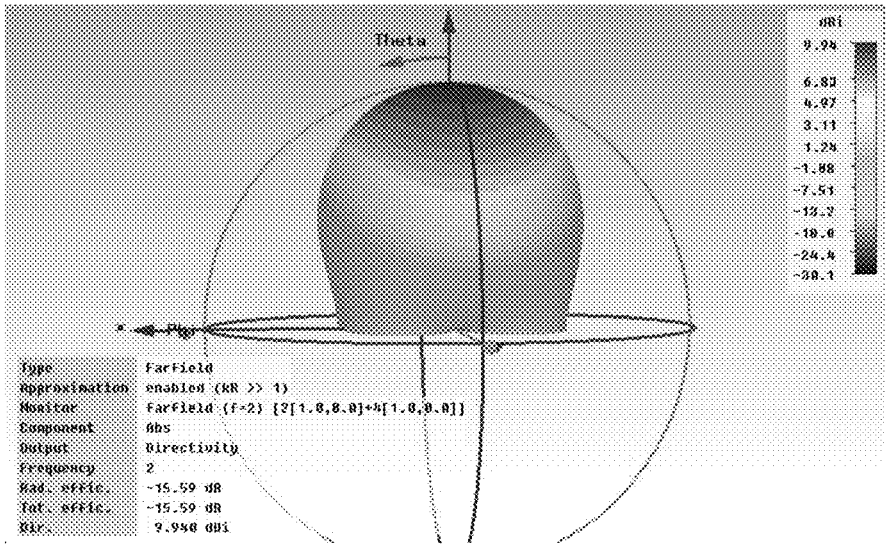

FIGS. 18A and 18B are computer simulations of the directivity pattern of a VLF embodiment of the NVIS antenna 10. In this embodiment, the spacing between the feed points 16 of dipoles $\mathbf{12}_c$ and $\mathbf{12}_d$ is 35.4 km and the spacing between the feed points 16 of dipoles $\mathbf{12}_a$ and $\mathbf{12}_b$ is 8 km. The height of the conducting elements 14 of the dipoles $\mathbf{12}_a$-$\mathbf{12}_d$ over ground is 30 m. Table 11 shows the efficiency, vertical gain, impedance and antenna length as a function of conductivity for this VLF embodiment of the NVIS antenna 10.

TABLE 11

(VLF NVIS Antenna, h = 30 m)

| σ (m/Ω) | Efficiency (dB) | Peak Gain (dB) | Directivity Gain (dBi) | Z for $12_c$ & $12_d$ (Ω) | Z for $12_a$ & $12_b$ (Ω) | Length (km) |
|---|---|---|---|---|---|---|
| 0.1 | −35.00 | 27.04 | 7.96 | 25.38 − j 0.505 | 25.38 − j 0.505 | 24.46 |
| 0.01 | −34.59 | −25.17 | 9.42 | 44.53 + j0.22 | 44.55 + j0.22 | 23.78 |
| 0.001 | −28.28 | −19.27 | 9.01 | 58.64 − j1.343 | 58.74 − j1.383 | 22.82 |
| 0.0001 | −21.49 | −12.26 | 9.23 | 66.18 − j1.563 | 67.11 − j1.935 | 21.94 |

The antenna pattern of the NVIS antenna 10 can pointed in the x-direction by applying a phase θ to dipole $\mathbf{12}_c$ and a phase −θ to dipole $\mathbf{12}_d$.

From the above description of the NVIS antenna 10, it is manifest that various techniques may be used for implementing the concepts of the NVIS antenna 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the NVIS antenna 10 is not limited to the particular embodiments described herein, but is capable of many embodiments without departing from the scope of the claims.

I claim:

1. An antenna array comprising:

four dipole antennas configured to function together as a directional, near vertical incidence skywave (NVIS) antenna with reduced side lobes, wherein each dipole antenna comprises two conductive elements and a feed point disposed between the two conductive elements, wherein the conductive elements of each of the four dipole antennas are disposed in an x-y plane of an x-y-z mutually orthogonal axes coordinate system, wherein a spacing between the feed points of the dipole elements positioned on the x-y plane is adjustable to reduce the side lobes, and wherein the conductive elements are substantially parallel with the x-axis and the x-y plane is substantially parallel with a ground plane that is common to the four dipole antennas; and wherein the feed points of the four dipole antennas are positioned on the x-y plane at approximately (x, 0), (−x, 0), (0, y), and (0, −y), and wherein the x-y plane is separated from the substantially parallel ground plane by a distance h that is less than or equal to 1/10 the wavelength (λ) of an operating frequency.

2. The antenna of claim 1, wherein the operating frequency is within the high frequency (HF) range.

3. The antenna of claim 1, wherein the operating frequency is within the very low frequency (VLF) spectrum.

4. The antenna of claim 2, wherein the spacing between the feed points of the dipole elements positioned on the x-y plane at approximately (x, 0), (−x, 0) is adjustable from λ/2 to λ, and the spacing between the feed points of the dipole elements positioned on the x-y plane at approximately (0, y) and (0, −y) is adjustable from of λ/1000to λ, such that the value x is within the range of λ/4 to λ/2, and the value y is within the range of λ/2000 to λ/2.

5. The antenna of claim 4, wherein the value x is 52.98 meters, the value y is 17.5 meters, h is 1 meter, and the operating frequency is 2 MHz.

6. The antenna of claim 1, wherein h is within the range of λ/10 to λ/10000.

7. The antenna of claim 1, wherein a phase of θ is applied to the dipole antenna at (−x, 0) and a phase of θ is applied to the dipole antenna at (x, 0) such that an antenna pattern of the NVIS antenna is redirected along the x-axis.

8. The antenna of claim 1, wherein the values y and x are approximately equal.

9. The antenna of claim 1, wherein the same power weight is not applied to each dipole antenna.

10. The antenna of claim 1, wherein the NVIS antenna is linearly polarized.

11. The antenna of claim 1, further comprising four additional dipole antennas, each disposed at 90 degrees to one of the four dipole antennas of claim 1 such that the NVIS antenna is capable of creating a circularly polarized signal.

12. The antenna of claim 1, wherein the ground plane is conductive.

13. The antenna of claim 1, further comprising a matching network and wherein at least one of the dipole antennas is operated below resonance (shorter than ½ λ).

14. A method for providing a directional, near vertical incidence skywave (NVIS) antenna with reduced side lobes comprising the following steps:

providing four dipole antennas, wherein each dipole antenna comprises two conductive elements and a feed point disposed between the two conductive elements;

positioning the four dipole antennas such that the conductive elements of each of the four dipole antennas are disposed in an x-y plane of an x-y-z mutually orthogonal axes coordinate system, wherein a spacing between the feed points of the dipole elements positioned on the x-y plane is adjustable to reduce the side lobes, wherein the dipole antennas are substantially parallel with the x-axis and the x-y plane is substantially parallel with a ground plane that is common to the four dipole antennas and is separated from the x-y plane by a distance h that is less than or equal to 1/10 the wavelength (λ) of an operating frequency; and positioning the feed points of the four dipole antennas on the x-y plane at approximately (x, 0), (−x, 0), (0, y), and (0, −y).

15. The method of claim 14, wherein the operating frequency is within the high frequency (HF) range.

16. The method of claim 14, wherein the operating frequency is within the very low frequency (VLF) spectrum.

17. The method of claim 15, wherein a spacing between the feed points of the dipole elements positioned on the x-y plane at approximately (x, 0), (−x, 0) is adjustable from λ/2 to λ, and a spacing between the feed points of the dipole elements positioned on the x-y plane at approximately (0, y) and (0, −y) is adjustable from of λ/1000 to λ, such that the value x is within the range of λ/4 to λ/2, and the value y is within the range of λ/2000 to λ/2.

18. The method of claim 14, wherein h is within the range of λ/10 to λ/10000.

19. The method of claim 14, further comprising the steps of: applying a phase of θ to the dipole antenna at (−x, 0); and applying a phase of −θ to the dipole antenna at (x, 0) such that an antenna pattern of the NVIS antenna is redirected along the x-axis.

20. The method of claim 14, further comprising the step of operating at least one of the dipole antennas below resonance (shorter than ½ λ) and wherein the NVIS antenna further comprises a matching network.

* * * * *